United States Patent [19]

Koppensteiner et al.

[11] 4,187,604

[45] Feb. 12, 1980

[54] TOOL AND METHOD FOR INSTALLING FLEXIBLE TUBING IN A MULTI-CAPSULE REED RELAY SWITCHING ASSEMBLY

[75] Inventors: James V. Koppensteiner, Chicago; Khaja M. Jameel, Glen Ellyn; Charles K. Kubik, Brookfield; George Len, Arlington Heights, all of Ill.

[73] Assignee: GTE Automatic Electric Laboratories Incorporated, Northlake, Ill.

[21] Appl. No.: 947,977

[22] Filed: Oct. 2, 1978

[51] Int. Cl.[2] ..... H01H 11/00

[52] U.S. Cl. ..... 29/622; 29/235; 29/280; 29/758; 200/301

[58] Field of Search ..... 29/758, 235, 280, 282, 29/729, 278, 622; 200/301, 288, 217; 335/152

[56] References Cited

U.S. PATENT DOCUMENTS

| | | | |
|---|---|---|---|
| 3,119,174 | 1/1964 | Wokeck | 29/235 |
| 3,128,356 | 4/1964 | Lychyk | 335/152 |
| 3,237,096 | 2/1966 | Zechman | 335/152 |
| 3,909,936 | 10/1975 | Ray | 29/758 |

*Primary Examiner*—Charlie T. Moon
*Assistant Examiner*—Gene P. Crosby
*Attorney, Agent, or Firm*—Robert J. Black

[57] ABSTRACT

A tool and method for installing a flexible tube between two or more glass encapsulated reed switches of a multi-capsule reed relay switching assembly. The tool is formed from a steel wire in a wedge shaped structure, adapted to compress when the tubing is fitted over it, exerting pressure against the inside wall of the tubing and narrowing the tubing into an egg-shaped configuration. This allows the insertion of the tubing between the reed capsules with a minimum of interference.

7 Claims, 3 Drawing Figures

TOOL AND METHOD FOR INSTALLING FLEXIBLE TUBING IN A MULTI-CAPSULE REED RELAY SWITCHING ASSEMBLY

BACKGROUND OF THE INVENTION (1) Field of the Invention

This invention relates in general to an insertion tool and more particularly to a tool for inserting flexible tubing between a pair of glass encapsulated reed switches of a multi-capsule reed relay switching assembly.

(2) Description of the Prior Art

The present invention has its origin in the need for inserting a flexible tube between two or more glass encapsulated reed switches. The function of the tubing disclosed in application Ser. No. 906,547 filed May 17, 1978 by Jameel and Kopensteiner and having a common assignee with the present invention, is to dampen resonant vibration in the capsules, reducing critical bounce which results in circuit malfunction.

Due to physical limitations, such as the restricted space between the capsules, the resiliency of the tubing and the high coefficient of surface friction between the glass reed capsules and the tubing, it was determined that a special tool would be needed to insert the tubing into place.

Additionally, the tool should lend itself not only to installing the tubing in a switching assembly during manufacture, but also in the field, where a great number of switching assemblies are currently operating and mounted on circuit cards. Thus, the tool should be convenient for use not only during manufacture but also in the crowded field environment of a circuit card which may also include other electronic components.

Accordingly, it is the object of the present invention to provide a simple, effective tool for inserting flexible tubing between two or more glass encapsulated reed switches of a multi-capsule reed relay switching assembly.

SUMMARY OF THE INVENTION

In accomplishing the object of the present invention, there is provided as the environment, a multi-capsule reed relay switching assembly or correed of the type to which the invention is applied. The correed includes a hollow bobbin having a flange and a base portion on each end, and at least two reed switches disposed longitudinally and in a spacial and parallel relation to each other within the bobbin.

The insertion tool, in accordance with the present invention, is formed from steel wire in a generally wedge shaped structure with a top member adapted to compress downward as a silicon glass fiber tube or other resilient tubing is fitted over it. As the top member is compressed and consequently tries to spring to its normal position it exerts a force against the inside wall of the tubing narrowing the tubing into an egg-shaped configuration which allows the tool with its now narrowed tubing to be inserted between the reed capsules with less interference. The tool is also equipped with a handle positioned perpendicular to the horizontal axis of the wedge. The handle is oriented in this manner as to facilitate insertion of the tubing in correeds mounted on circuit cards. A stop portion on a rear end of the top member keeps the tubing from sliding back towards the tool handle during insertion. The high coefficient of friction between the silicon rubber and glass reed capsules overcome the pressure fit of the tubing on the tool when the tool is withdrawn thus leaving the tubing in place between the capsules.

DESCRIPTION OF THE DRAWINGS

A better understanding of the invention may be had from a consideration of the following detailed description taken in conjunction with the accompanying drawings in which.

DESCRIPTION OF THE PREFERRED EMBODIMENT

Figure 1:
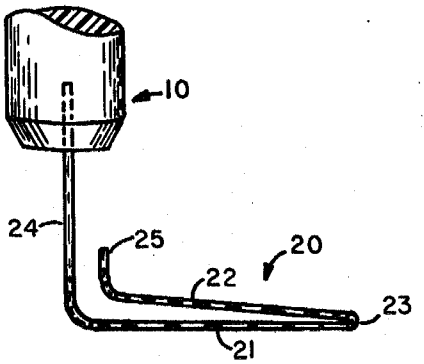
FIG. 1 is a side elevational view of the insertion tool in accordance with the present invention described herein.

Referring now to the accompanying drawings, FIG. 1 illustrates the insertion tool according to the principles of the present invention. The tool is comprised of two elements, a generally wedge shaped insertion element 20 and a gripping handle 10. The insertion element is formed from a continuous 0.032 diameter steel wire and includes a horizontal bottom leg 21 and an angularly displaced top leg 22. Legs 21 and 22 are joined at one end by an integral insertion knee 23 allowing top leg 22 to act as a spring and to deflect downward upon bottom leg 21. An upstanding handle mounting member 24 is integrally joined to a second end of bottom leg 21 and is disposed to mount a gripping handle 10 thereon. An opposite end of top leg 22 further includes an upstanding stop member 25 in a spacial and parallel relationship to handle mounting member 24.

Figure 2:
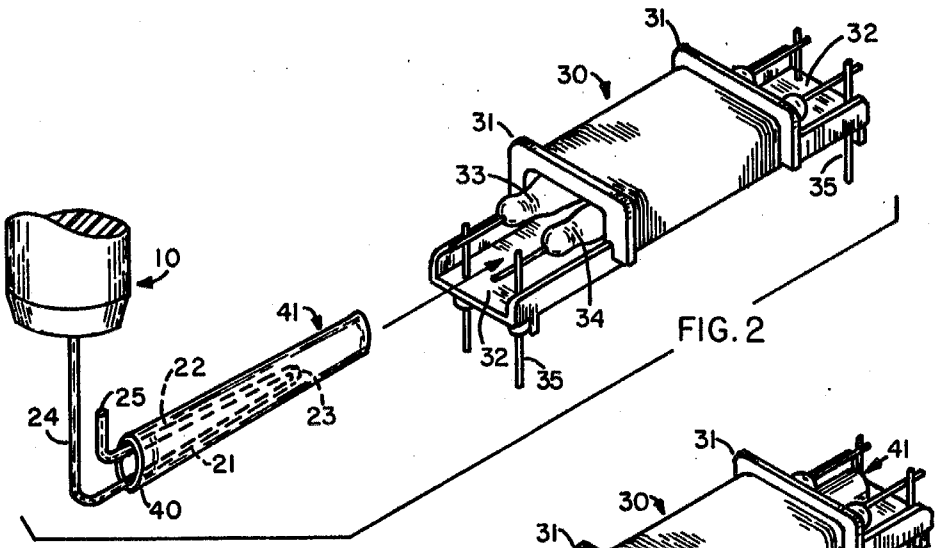
FIG. 2 is a detailed perspective view of a multi-capsule reed relay switching assembly of the type to which the present invention is applied and a silicon glass fiber tube installed on the insertion tool prior to the insertion of the tubing into the multi-capsule reed relay switching assembly.

Referring now to FIG. 2, a multi-capsule reed relay switching assembly or correed of the type to which the invention is applied is represented by hollow bobbin 30, having a flange 31 and a base portion 32 on each end. A pair of glass encapsulated magnetic latching reed switches 33, 34 are disposed longitudinally within the bobbin. Terminals 35 extend through each base portion and are connected to respective reed switch leads providing mechanical support and electrical connections. It should be noted that this description of the correed illustrates the functional environment in this embodiment and forms no part of the invention.

The insertion tool is used to advantage by first fitting a round silicon glass fiber tube 40 over insertion knee 23, bottom leg 21 and top leg 22. The tube 40 is approximately 0.098 inch to 0.112 inch in diameter with a 0.066 inch to 0.080 inch wall and is cut to an appropriate length corresponding to the physical length of each magnetic latching reed capsule.

As tube 40 is fitted over insertion element 20, leg 22 is deflected downward from its normal position which consequently applies a force upward against the inside wall of tubing 40 narrowing the tubing into a vertically elongated or egg-shaped configuration.

Tubing 40 is substantially fitted over insertion element 20, leaving a portion shown generally as 41 in its original and rounded form. The tool is then positioned for insertion by aligning the insertion element 20, carrying the now egg-shaped tubing, parallel and handle 10 perpendicular to reed capsules 33 and 34. Portion 41 is then inserted into bobbin 30 between the reed capsules in a forward direction. A small amount of interference is experienced initially due to the circular form of portion 41, with the tube consequently sliding backward against stop member 25. This backward directional travel of the tube helps relieve any high frictional pressure build up between the tubing and glass which may cause breakage of the delicate glass envelopes of the reed capsules.

Figure 3:
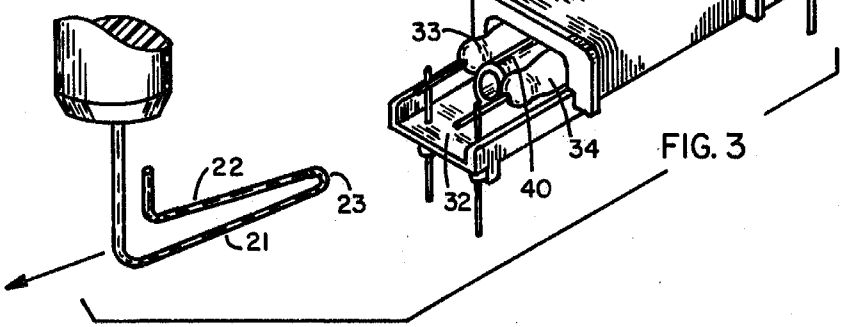
FIG. 3 is a detailed perspective view showing the installed tubing and the insertion tool withdrawn.

It should be noted that the tubing is greater in length than the insertion element 20, which when fully installed over legs 21 and 22 and against stop member 25 still allows a substantial quantity of portion 41 to retain its rounded form. Upon complete insertion of the tubing, the tool is withdrawn backward out of correed 30, as shown on FIG. 3. The high coefficient of friction between the silicon rubber tubing and the glass capsules at portion 41 overcomes the pressure fit exerted by leg 22 which consequently allows withdrawal of the tool leaving the tubing in place. Additionally, upon initial withdrawal, leg 21 begins to spring back to its original position, permitting the tubing to expand progressively between the reed capsules as the tool is withdrawn out of the correed. Increasing the glass to tubing contact area and allowing for a secure fitting.

The present invention has been described with reference to a specific embodiment thereof, for the purpose of illustrating the manner in which the invention may be used to advantage, and it will be appreciated by those skilled in the art that the invention is not limited thereto. Accordingly any and all modifications, variations, or equivalent arrangements which may occur to those skilled in the art, should be considered to be within the scope of the invention.

We claim:

1. A tool for inserting a flexible tube between two or more parallel and spaced apart glass encapsulated reed switches of a reed relay switching assembly, said tool comprising;

a rigid horizontal bottom leg including first and second ends;

a deflectable and angularly positioned top leg including first and second ends; and, a rounded insertion knee joining said top leg first end and said bottom leg first end;

said tool slidably inserted into said tubing, deflecting said top leg toward said bottom leg and causing said top leg to apply pressure to an inside wall of said tubing, vertically elongating said tubing and allowing for insertion of said tubing between said reed switches.

2. A tool as recited in claim 1, wherein: said bottom leg second end includes a handle mounting member vertically oriented and perpendicular to said bottom leg.

3. A tool as recited in claim 2, wherein: a gripping handle is fixedly mounted to said handle mounting member.

4. A tool as recited in claim 2, wherein: said top leg second end includes a vertically oriented stop member spaced apart and parallel to said handle mounting member.

5. A tool as recited in claim 3, wherein: said top and bottom legs, insertion knee, handle mounting member and stop member are a continuous unitary structure formed from a rigid material.

6. The method of inserting a flexible tube between two or more parallel and spaced apart glass encapsulated reed switches of a reed relay switching assembly comprising the steps of:

fitting a flexible tube including inner and outer walls over an insertion tool, said tool including a horizontal bottom leg, a deflectable and angularly displaced top leg and a rounded insertion knee joining said top and bottom legs at one end, said top leg adapted to deflect toward said bottom leg when said tool is slidably inserted into said tubing causing said top leg to apply pressure to an inner wall of said tubing, vertically elongating said tubing;

inserting said tool and said tubing between said reed switches in a first direction;

withdrawing said tool in a second and opposite direction allowing said tubing to return to its original rounded form causing a friction fit between said outer walls of said tubing and said capsules progressively as said tool is withdrawn from said tubing allowing said top leg to return to its normal undeflected position.

7. The method as recited in claim 6, wherein: said top leg further includes a vertically oriented stop member on an opposite end, arranged to stop backward movement of said tubing when said tool is inserted between said reed switches.

* * * * *